US012043431B2

(12) United States Patent
Herzberger

(10) Patent No.: US 12,043,431 B2
(45) Date of Patent: Jul. 23, 2024

(54) TRANSFER APPARATUS FOR ARRANGING ON A TUBULAR BAG MACHINE

(71) Applicant: ROVEMA GMBH, Fernwald (DE)

(72) Inventor: Holger Herzberger, Ebsdorfergrund (DE)

(73) Assignee: ROVEMA GMBH, Fernwald (DE)

( * ) Notice: Subject to any disclaimer, the term of this patent is extended or adjusted under 35 U.S.C. 154(b) by 379 days.

(21) Appl. No.: 17/435,908

(22) PCT Filed: Feb. 25, 2020

(86) PCT No.: PCT/EP2020/054856
§ 371 (c)(1),
(2) Date: Sep. 2, 2021

(87) PCT Pub. No.: WO2020/178071
PCT Pub. Date: Sep. 10, 2020

(65) Prior Publication Data

US 2022/0315260 A1 Oct. 6, 2022

(30) Foreign Application Priority Data

Mar. 6, 2019 (DE) ..... 10 2019 105 623.3

(51) Int. Cl.
*B65B 1/36* (2006.01)
*B65B 1/06* (2006.01)
(Continued)

(52) U.S. Cl.
CPC ..... *B65B 37/20* (2013.01); *B65B 1/06* (2013.01); *B65B 1/12* (2013.01); *B65B 1/36* (2013.01); *B65B 57/14* (2013.01)

(58) Field of Classification Search
CPC .... B65B 1/06; B65B 1/12; B65B 1/36; B65B 37/20
See application file for complete search history.

(56) References Cited

U.S. PATENT DOCUMENTS 8,151,802 B2 4/2012 Boldrini
2011/0005172 A1 1/2011 Miyahara et al.
(Continued)

FOREIGN PATENT DOCUMENTS

DE 4409257 A1 9/1995
DE 102014219448 A1 3/2016
(Continued)

OTHER PUBLICATIONS

PCT International Search Report, PCT/EP2020/054856, Jul. 3, 2020, 8 pages.
(Continued)

*Primary Examiner* — Jason K Niesz
(74) *Attorney, Agent, or Firm* — Quarles & Brady LLP

(57) ABSTRACT

A transfer element for being arranged between a dosing device and the filling device of a tubular bag machine, the dosing device allowing for the dosing of a prespecified filling quantity of the filling material to be filled into a tubular bag, and the transfer element comprising at least one input station, at least one dispensing station and several transfer containers, and a prespecified filling quantity of a filling material being transferable from the dosing device to the transfer containers in the input station, and the transfer containers being transported to the dispensing station along a transfer line, and the filling material being transferable from the transfer containers to the filling device in the dispensing station, and the transfer containers being transported back to the input station along a return transfer line, the transfer element being controlled by a transfer control system, the transfer control system controlling the transfer process for transferring the filling material from a transfer container to the filling device of the tubular bag machine in the dispensing station a) in accordance with the position of
(Continued)

the transfer container relative to the filling device and/or b) in accordance with the speed of the transfer container.

12 Claims, 8 Drawing Sheets

(51) Int. Cl.

| | |
|---|---|
| ***B65B 1/12*** | (2006.01) |
| ***B65B 37/20*** | (2006.01) |
| ***B65B 57/14*** | (2006.01) |

(56) References Cited

U.S. PATENT DOCUMENTS

| | | | | |
|---|---|---|---|---|
| 2012/0060446 | A1* | 3/2012 | Merz | B65B 37/20 53/167 |
| 2012/0204522 | A1 | 8/2012 | Kondo et al. | |
| 2012/0297738 | A1 | 11/2012 | Krause et al. | |
| 2017/0361953 | A1* | 12/2017 | Piepenbrock | B65B 37/04 |
| 2019/0161216 | A1* | 5/2019 | Rivola | B65B 29/028 |

FOREIGN PATENT DOCUMENTS

| | | | |
|---|---|---|---|
| EP | 1067046 | A1 | 1/2001 |
| WO | 9112177 | A1 | 8/1991 |
| WO | 9948757 | A1 | 9/1999 |

OTHER PUBLICATIONS

PCT English Language Translation of the International Preliminary Report on Patentability, PCT/EP2020/054856, Sep. 16, 2021, 11 pages.

* cited by examiner

TRANSFER APPARATUS FOR ARRANGING ON A TUBULAR BAG MACHINE

This application represents the national stage entry of PCT International Application No. PCT/EP2020/054856 filed on Feb. 25, 2020, which claims the benefit of German Patent Application No. 10 2019 105 623.3 filed on Mar. 6, 2019, the entire contents of which are incorporated herein by reference for all purposes.

The disclosure relates to a transfer element for being arranged between a dosing device and the filling device of a tubular bag machine according to the preamble of claim 1. The tubular bag machine can be equipped with a longitudinal sealing element for forming a film tube, for example. This film tube is then sealed transversely in the tubular bag machine by means of two transverse sealing jaws which are moveable against each other and which thereby transversely seal the film tube, such that tubular bags can be produced continuously or intermittently. Before the tubular bags are sealed, the tubular bags are filled with the filling material by means of a filling device. After the tubular bags have been sealed transversely, the individual tubular bags are separated from each other by means of a separating element.

A tubular bag machine of this kind is known from EP 0 469 105, for example.

In known tubular bag machines, a dosing device is disposed upstream of the filling device. Each portion of the filling material is separated in the dosing device in order to fill the tubular bag with the prespecified quantity, for example a prespecified filling weight, a prespecified filling volume or a prespecified filling amount. In the known tubular bag machines, the dosing device operates synchronously to the tubular bag machine in order for the filling device to be able to fill the amount of filling material required for filling the tubular bag at each exact required point in time. This synchronous operation between the dosing device and the tubular bag machine increasingly leads to problems.

A first disadvantage of the synchronous operation between the dosing device and the tubular bag machine is that each little process interference during the dosing in the dosing device leads to a standstill or to an idle cycle in the tubular bag machine. In particular in the case of high-performance tubular bag machines with a performance of more than 200 tubular bags per minute, maintaining the synchronicity between the tubular bag machine and the dosing device is extremely complex. A further performance increase during the packaging of the filling materials using high-performance tubular bag machines is thus no longer possible using the known systems, or only possible with great effort.

Based on this state of the art, it is therefore the object of the disclosure to propose a transfer element for being arranged between a dosing device and the filling device of a tubular bag machine, by means of which the packaging performance of the tubular bag machine can be increased with relatively little effort. Furthermore, it is the object of the present disclosure to propose a method for operating such a transfer element.

Advantageous embodiments of the disclosure are the subject matter of the dependent claims.

The transfer element according to the disclosure comprises an input station, a dispensing station and several transfer containers. In the input station, each prespecified filling quantity of the filling material for being filled into a tubular bag is transferred from the dosing device to each transfer container located in the input station. Subsequently, the transfer containers are transported to the dispensing station along a transfer line. In turn, the transfer containers are emptied in the dispensing station and the filling material transferred in the transfer containers is transferred to the filling device of the tubular bag machine. Lastly, the transfer containers are transported back to the input station along the return transfer line and there they are filled again with filling material from the dosing device.

To increase the performance of the transfer element during the transfer of the filling material to the filling device of the tubular bag machine, a transfer control system for controlling the transfer element during the transfer of the filling material to the tubular bag machine is provided according to the disclosure. In this case, the transfer control system is realized such that the transfer process in the dispensing station can be controlled either a) in accordance with the position of the transfer container relative to the filling device and/or b) in accordance with the speed of the transfer container. Contrary to currently common transfer processes, this means that the transfer container does not have to come to a complete standstill above the filling device for the transfer of the filling material from the transfer container to start. Instead, the transfer process can already be initiated before the transfer container comes to a complete standstill above the filling device either in accordance with the position of the transfer container and/or in accordance with the speed of the transfer container.

How the transfer process is controlled by the transfer control system in accordance with the position of the transfer container or in accordance with the speed of the transfer container, is generally arbitrary. According to a preferred embodiment, the transfer containers each have a seal, which can be adjusted between a closed position and an open position. In the closed position of the seal, the transfer container is closed and the filling material is stored in the transfer container. By adjusting the seal to the open position, the transfer container is opened, such that the filling material is transferred from the opening of the transfer container to the filling device under the influence of gravity. According to this preferred embodiment of the device, the seal of the transfer container can be opened in accordance with the position of the transfer container relative to the filling device and/or in accordance with the speed of the transfer container. As a result, it can be achieved that the seal of the transfer container is already opened before the transfer container has come to a complete standstill above the filling device, such that, gravity alone will cause the filling material to slide downward before the transfer container comes to a complete standstill in the dispensing station. Through this early start of adjusting the seal from the closed position to the open position, process time needed for transferring the filling material from the transfer container into the filling device of the tubular bag machine can be saved in order to realize a higher packaging performance of the tubular bag machine by increasing the work cycle.

In view of an additional increase in packaging performance, it is advantageous if the transport volume of the transfer containers, in which the filling material is accommodated, has a cross section which expands from the top towards the bottom. If the transfer container is equipped with a seal, for example, by means of which an opening in the transfer container is closed, the opening of said seal causes the whole filling material stored in the transport volume to simultaneously slide downward vertically. The walls of the transfer container have almost no static friction-related braking effect because of the cross section of the transport volume expanding towards the bottom.

In view of the increase in the packaging performance of the tubular bag machine it is also advantageous if the cross section of the transport volume essentially matches the cross section at the inlet of the filling device of the tubular bag machine in the area of the seal of the transfer container. Since the filling material in the transport volume of the transfer container is already preformatted, a formatting of the filling material at the inlet of the filling device, which otherwise needs to be effected by means of appropriate funnels, can be omitted. Instead, the filling material slides essentially congruently out of the cross section of the transport volume in the transfer container into the cross section of the filling device located below. In order to variably adjust the transfer element to different transfer tasks, for example the transfer of different filling materials, it is especially advantageous if the cross section of the transport volume in the transfer containers is adaptable. Thus, it can be achieved that the same transfer containers can be used for charging filling devices having different cross sections. To achieve another performance increase during the filling of the tubular bags, it is advantageous if a discharge element, by means of which the filling material can be dis-charged from the transport volume of the transfer container, is provided on the transfer containers and/or in the dispensing station. Such a discharge element can in particular also support gravity during the discharge of the transfer containers.

The discharge element can generally have any form. Thus, in particular discharge elements which operate mechanically are also conceivable. Regarding the flexibility of the discharge element, it is especially advantageous if said discharge element is realized in the manner of a compressed-air nozzle. By means of the compressed air discharged from the compressed-air nozzle, the filling material can be pressed out of the transfer container and blown into the filling device of the tubular bag machine.

The filling device, at which the filling material is transferred from the transfer element, can generally also have any form. According to a preferred embodiment, the filling device is realized in the manner of a forming tube, the film tube being guided on the outer surface of the forming tube for forming tubular bags.

Various devices are conceivable as dosing devices for dosing the filling material into the transfer containers of the transfer element. Preferably, the dosing device can be realized in the manner of a weighing scale or a screw conveyor or a meter or a volume dosing element.

For the transfer control system to be able to control the transfer processes in accordance with the position of the transfer container or in accordance with the speed of the transfer container, it is especially advantageous if a corresponding sensor technology for measuring the position or the speed of the transfer containers is provided. By means of this sensor technology, the actual values of the conveying speed or the position of the transfer containers can be measured and transmitted to the transfer control system.

Coordinating the movement sequences in the transfer element with the movement sequences in the tubular bag machine is highly important for the operation of the transfer element according to the disclosure, because movement kinematics must be precisely coordinated, especially in the case of high cycle frequency. To enable this in a simple manner, it is especially advantageous if the transfer control system has a data interface by means of which the transfer control system can exchange data with the control system of the tubular bag machine. In this manner, a synchronization between transfer control system and the control system of the tubular bag machine can easily be realized.

The method according to the disclosure is characterized by the fact that during the transport movement of the transfer container in the dispensing station, the filling material is transferred at least partly to the filling device of the tubular bag machine. A complete standstill of the transfer containers during the transfer of the filling material is thus no longer necessary, which allows for a significant performance increase for the transfer of the filling material. Preferably, the seal of a transfer container is opened before the transfer container (13) comes to a complete stop in the dispensing station, in order to start the transfer process by already adjusting the seal from its closed position to the open position before the transfer containers come to a standstill.

An embodiment of the disclosure is schematically illustrated in the drawings and is described in an exemplary manner hereinafter.

Figure 1:
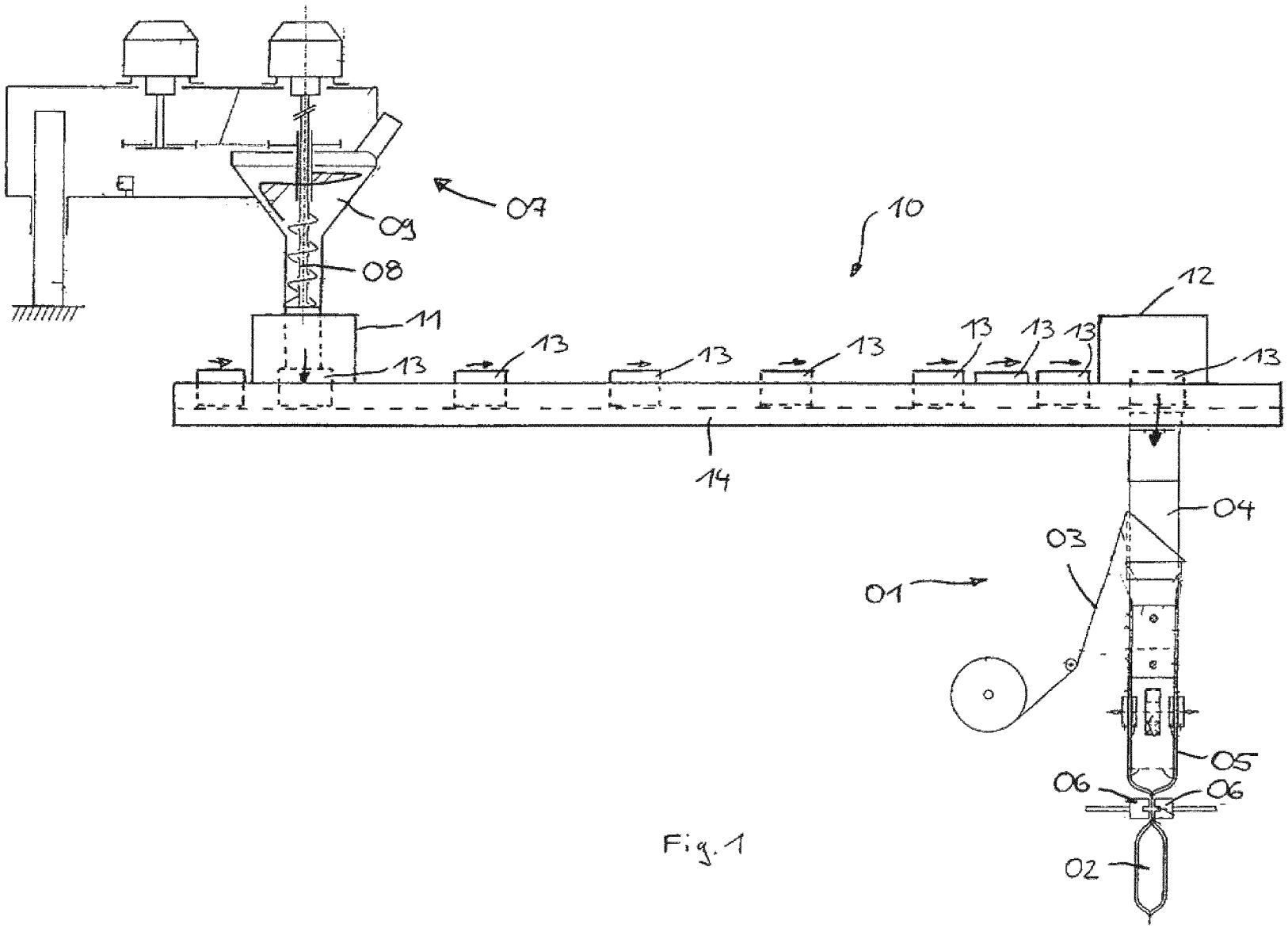
FIG. 1 shows a transfer element for being arranged between a dosing device and a tubular bag machine in a side view.

FIG. 1 shows a tubular bag machine 01 for producing tubular bags 02. In the production of tubular bags 02, a packaging film 03 is first formed into a tube around a forming tube, which serves as a filling device 04, and is then sealed longitudinally. Thus formed film tube 05 is sealed transversely by means of transverse sealing jaws 06 and is thus closed at the upper or lower end. Tubular bag 02, which has not been closed at the upper end thus far, is filled with a filling material by filling device 04 during the filling process in tubular bag machine 01, the filling material falling into the still open tubular bag from above through the internal cross section of the forming tube.

A dosing device 07 is disposed upstream of tubular bag machine 01, said dosing device 07 being formed in the manner of a dosing screw 08 having a corresponding drive in the illustrated embodiment. By suitably driving dosing screw 08, a prespecified filling volume of the filling material can be discharged from a filling material funnel 09.

A transfer element 10 is disposed between tubular bag machine 01 and dosing device 07. Transfer element 10 comprises an input station 11 and a dispensing station 12. Transfer containers 13 of dosing device 07 can be filled with the pre-dosed amount of the filling material in input station 11. Subsequently, transfer containers 13 are transported along a transfer line 14 to dispensing station 12. Transfer containers 13 are emptied into dispensing station 12, such that the prespecified amount of the filling material falls into the open tubular bags from above through filling device 04. In this case, transfer containers 13 are filled in input station 11 irrespective of the emptying of transfer containers 13 in the dispensing station, such that a synchronicity between the dosing process in dosing device 07 and the tubular bag filling process in tubular bag machine 01 is no longer required. By varying the conveying speed of transfer containers 13 along transfer line 14, synchronicity deviations between the two processes can be easily compensated.

Figure 2:
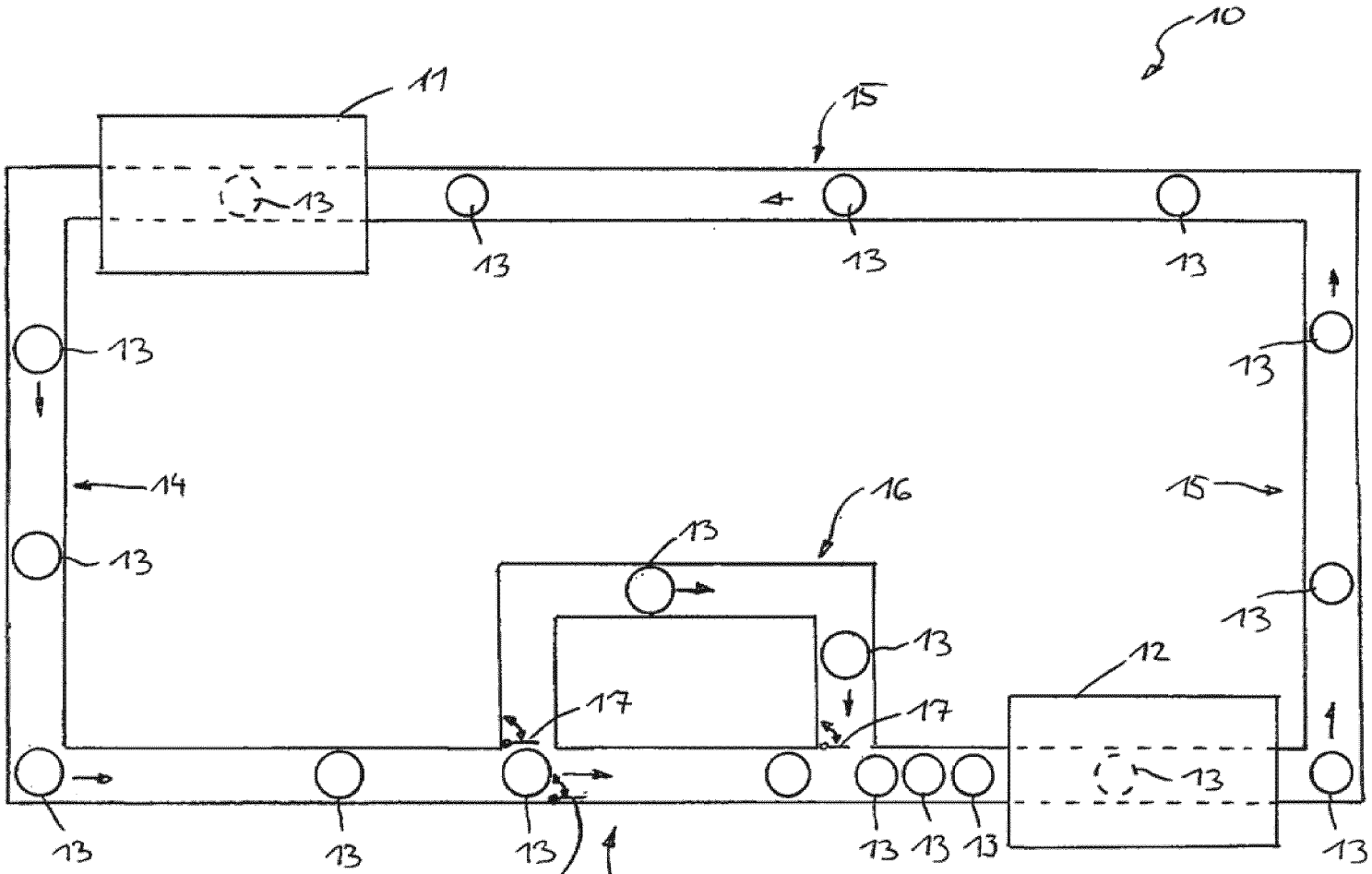
FIG. 2 shows the transfer element according to FIG. 1 in a top view.

FIG. 2 shows transfer element 10 having input station 11 and dispensing station 12 in a schematic top view. As can be seen in FIG. 2, transfer containers 13 are transported back to input station 11 along a return transfer line 15 after the emptying into dispensing station 12, such that they can be filled there once again with a pre-dosed amount of the filling material. In order to also compensate for larger synchronicity deviations between the filling of the transfer containers in input station 11 and the emptying of transfer containers 13 into dispensing station 12, transfer line 14 also comprises a buffer 16 in which several transfer containers 13 can be stored temporarily. Switch elements 17 serve for filling or emptying transfer containers 13 in buffer 16.

Figure 3:
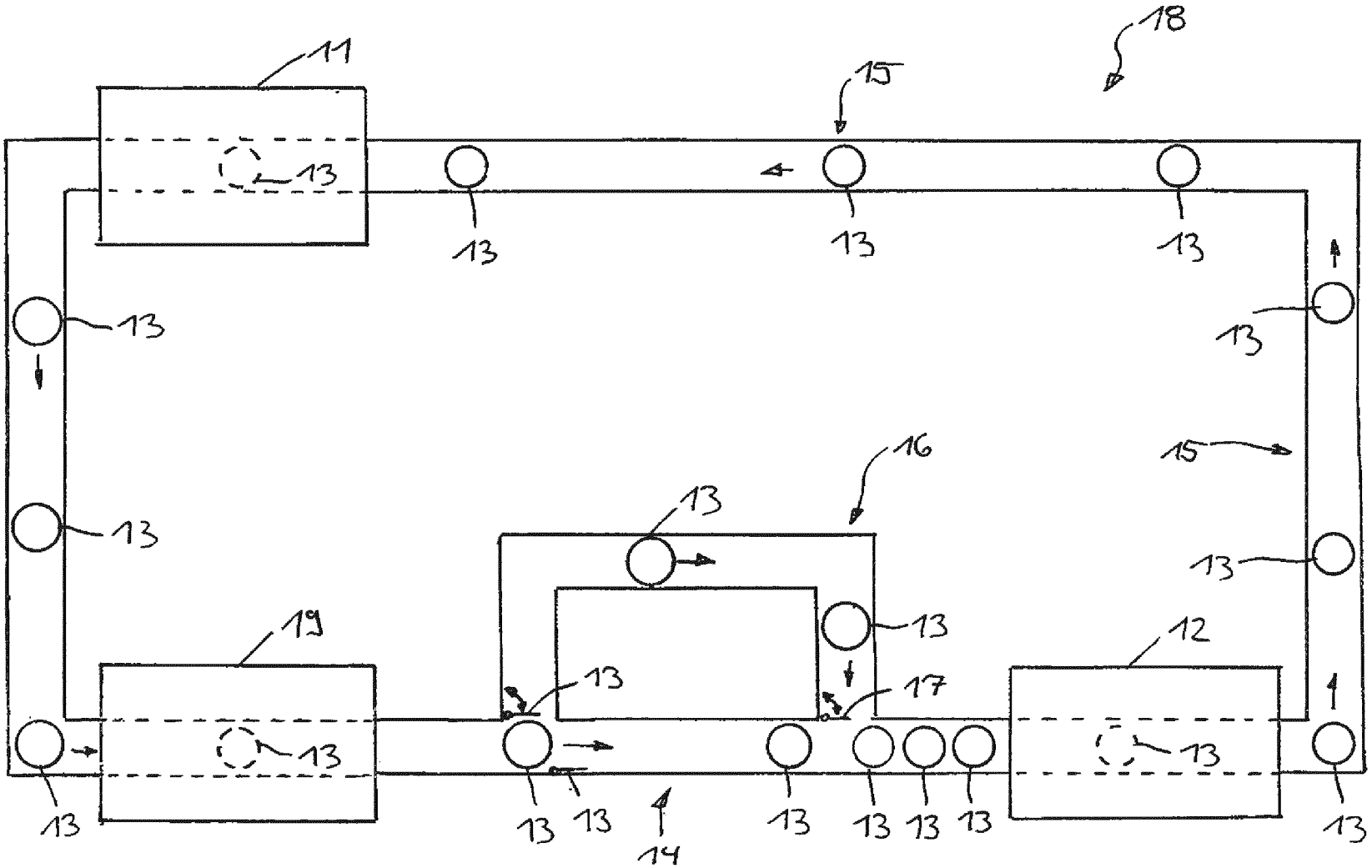
FIG. 3 shows a second embodiment of a transfer element in a top view.

FIG. 3 shows an alternative embodiment of a transfer element 18. The basic design of transfer element 18 corresponds to the design of transfer element 10, transfer element 18 comprising an additional input station 19. In turn, transfer containers 13 can be filled with pre-dosed filling quantities of a filling material at additional input station 19 using an additional dosing device. It is conceivable that different transfer containers are each filled with filling material in input stations 11 and 19 in order to increase the required dosing capacity in this manner by using two dosing devices. Alternatively, transfer containers 13 can also be filled with different filling materials each in input stations 11 and 19, such that each transfer container contains a pre-dosed mix of filling materials after leaving input station 19.

Figure 4:
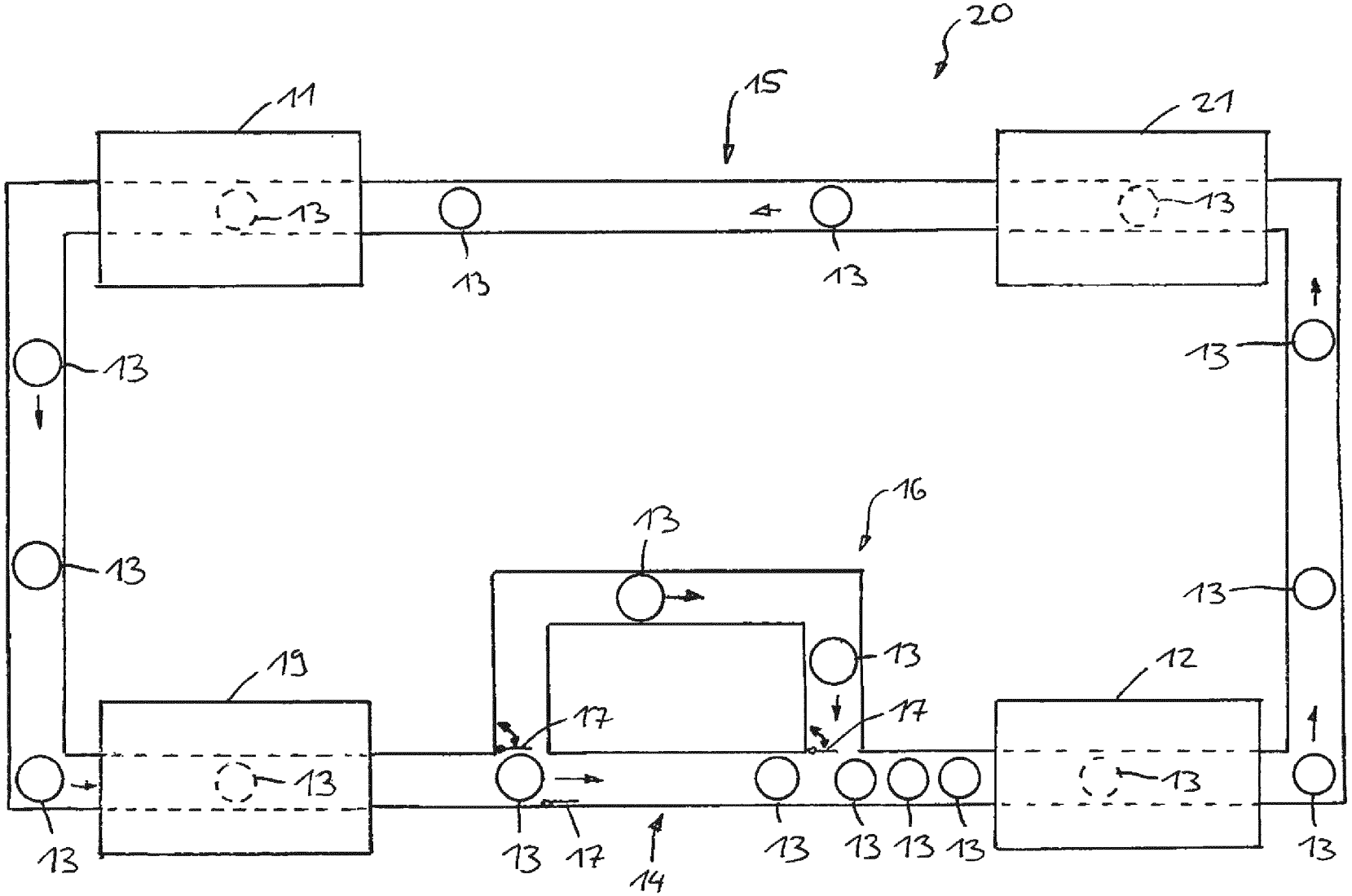
FIG. 4 shows a third embodiment of a transfer element in a top view.

FIG. 4 shows a third embodiment of a transfer element 20. Transfer element 20 differs from transfer element 18 in that an additional dispensing station 21 is used. As a result, transfer containers 13 can, on the one hand, be filled with filling material in input stations 11 and 19 by means of transfer element 20 using different dosing devices and then, the filling materials can be dispensed to two different tubular bag machines from transfer containers 13 at dispensing stations 12 and 21. In so far as the transfer elements comprise additional input stations or dispensing stations, more complex transfer systems, which are made of a plurality of dosing devices and a plurality of tubular bag machines, can be realized.

Figure 5:
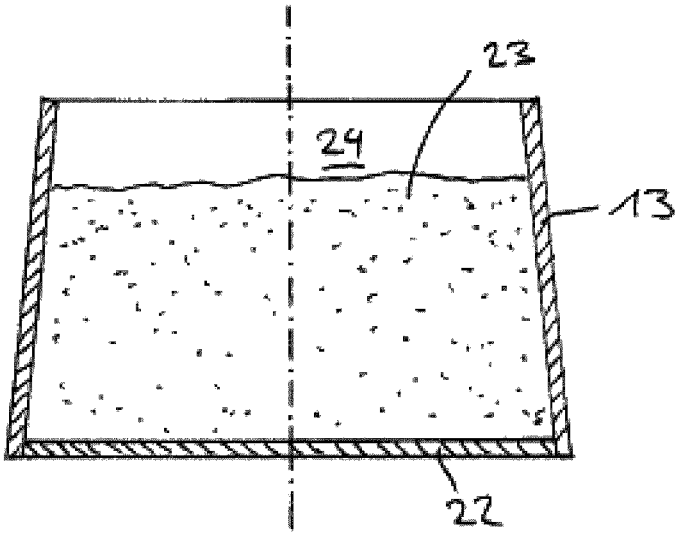
FIG. 5 shows a transfer container for being used in a transfer element according to FIG. 2 or FIG. 3 having a seal in the closed position in cross section.

FIG. 5 shows transfer container 13 for being used in transfer elements 10, 18 and 20 in cross section. The bottom of transfer container 13 is realized by a seal 22, which is mounted on transfer container 13 so as to be pivotable and which can be adjusted by motor by means of a drive element (not illustrated in FIG. 5) between the closed position (illustrated in FIG. 5) and the open position (illustrated in FIG. 6). In FIG. 5, seal 22 is in its closed position, such that filling material 23 can be transported in transport volume 24 of transfer container 13.

Figure 6:
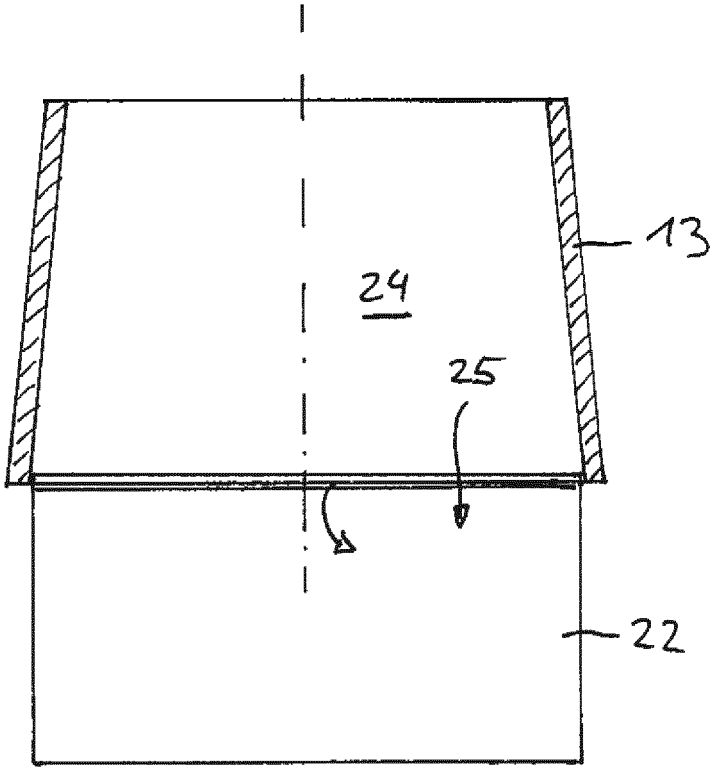
FIG. 6 shows the transfer container according to FIG. 5 having a seal in the open position in cross section.

FIG. 6 shows transfer container 13 having open seal 22. By opening seal 22, filling material 23 falls through opening 25 of transfer container 13 under the influence of gravity. In this case, transport volume 24 has a cross section which expands towards the bottom, such that after opening seal 22, the falling movement of filling material 23 is not impeded by the friction on the inner walls of transfer container 13.

Hereinafter, the function of transfer elements 10, 18 and 20 during the transfer of filling material 23 to filling device 04 of tubular bag machine 01 will be described in more detail with reference to the drawings of FIG. 7, FIG. 8 and FIG. 9.

Figure 7:
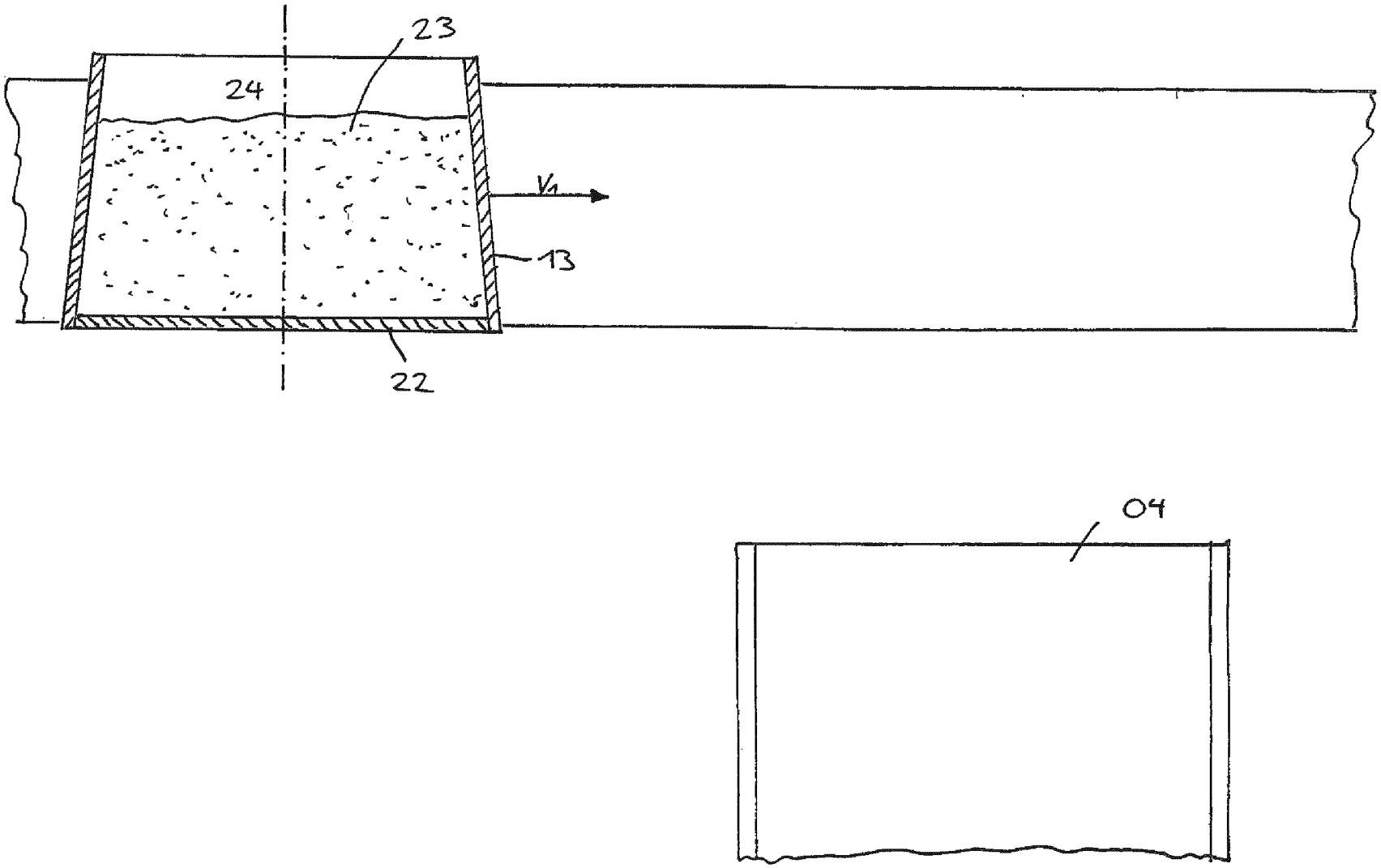
FIG. 7 shows the transfer container according to FIG. 5 at the start of the transfer processes for transferring a filling material into the filling device of a tubular bag machine in schematic cross section.

FIG. 7 shows transfer container 13 approaching the transfer position in dispensing station 12 or 21 above filing device 04 of tubular bag machine 01 at a conveying speed $V_1$. Seal 22 is still in its closed position and transfer container 13 thus fully closed.

Figure 8:
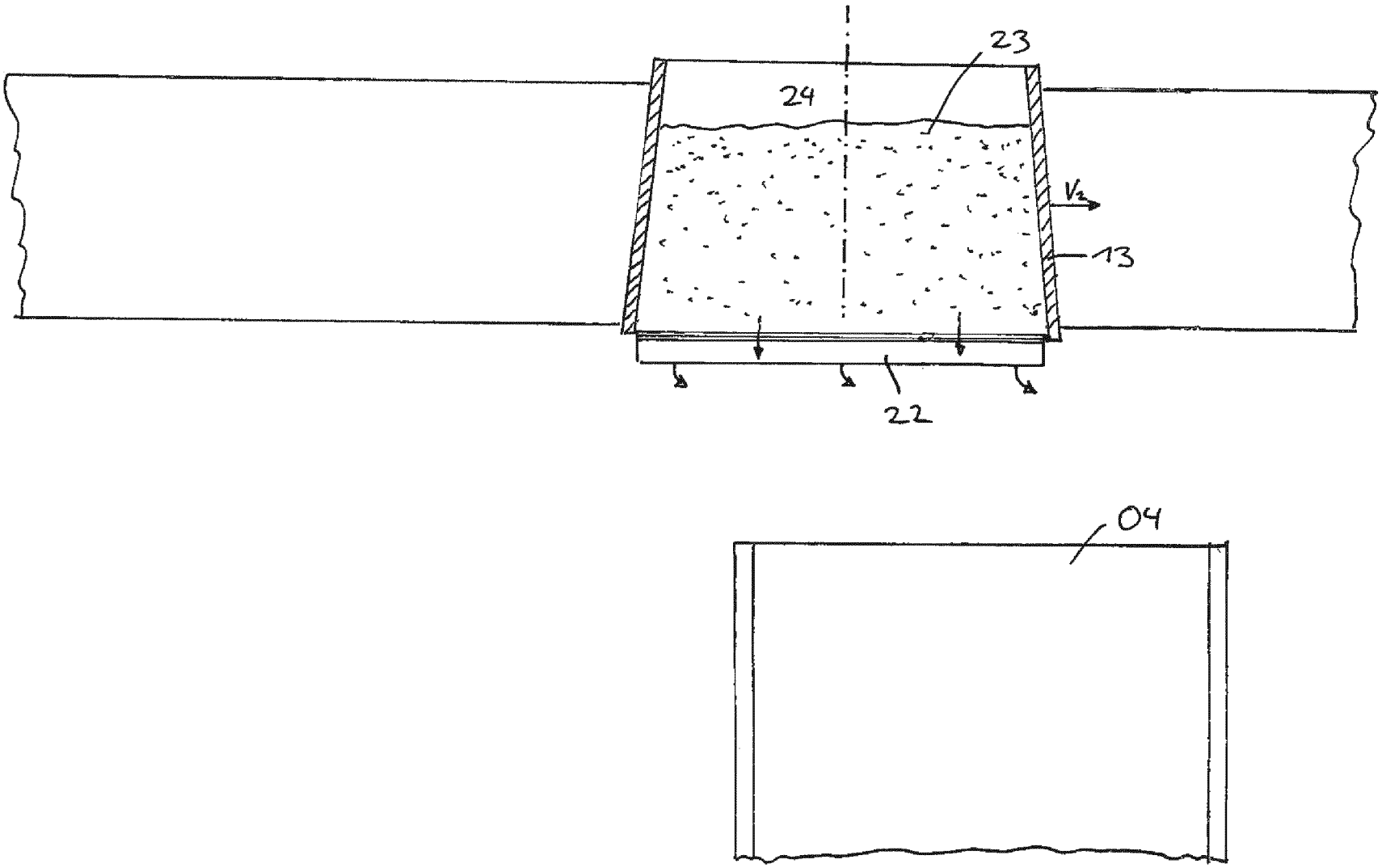
FIG. 8 shows the transfer container according to FIG. 7 in a second phase for transferring the filling material into a filling device after the seal has been opened in cross section.

In the position of transfer container 13 shown in FIG. 8, said transfer container 13 has already come very close to the transfer position above filling device 04. After reaching a specific position upstream of the transfer position, however, before complete standstill in the transfer position, seal 22 is already being opened (as schematically illustrated in FIG. 8) and thus, the transfer process already begins before the complete standstill. In other words, this means that although transfer container 13 is still moving towards the transfer position above filling device 04 at a conveying speed $V_2$, the transfer process already starts by opening seal 22, such that in a superimposed horizontal and vertical movement, filling material 23 falls towards the opening cross section of filling device 04.

Figure 9:
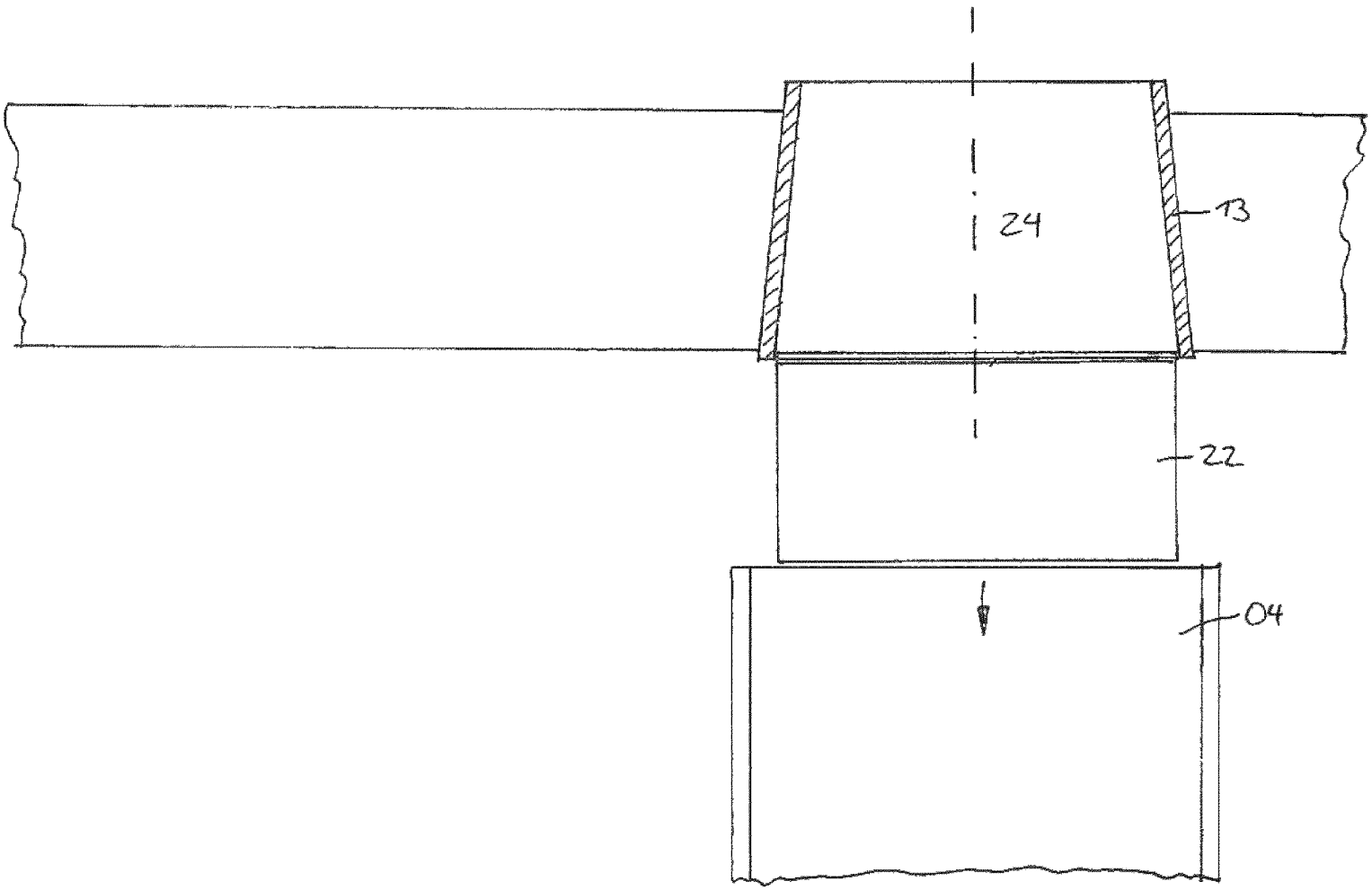
FIG. 9 shows the transfer container according to FIG. 8 after a complete standstill above the filling device and complete opening of the seal and complete discharge in schematic cross section.

FIG. 9 shows transfer container 13 after reaching the transfer position above filling device 04. In this position, transfer container 13 does no longer have any horizontal speed, instead, is has come to a complete standstill. By fully opening seal 22, filling material 23 was fully discharged from transfer container 13 and transferred to filling device 04. As soon as the transfer container (as schematically illustrated in FIG. 9) is fully discharged, seal 22 is again pivoted upwards by means of the corresponding drive element and the transfer container is thus closed. Simultaneously, transfer container 13 is set in motion again and is transported towards input stations 11 or 19.

The invention claimed is:

1. A transfer element for being arranged between a dosing device and the filling device of a tubular bag machine, the dosing device allowing for the dosing of a prespecified filling quantity of the filling material to be filled into a tubular bag, and the transfer element comprising at least one input station, at least one dispensing station and several transfer containers, and a prespecified filling quantity of a filling material being transferable from the dosing device to the transfer containers in the input station, and the transfer containers being transported to the dispensing station along a transfer line, and the filling material being transferable from the transfer containers to the filling device in the dispensing station, and the transfer containers being transported back to the input station along a return transfer line, wherein the transfer element is controlled by a transfer control system, the transfer control system controlling the transfer process for transferring the filling material from a transfer container to the filling device of the tubular bag machine in the dispensing station a) in accordance with the position of the transfer container relative to the filling device and/or b) in accordance with the speed of the transfer container.

2. The transfer element according to claim 1, wherein the transfer containers have a seal, which can be adjusted between a closed position and an open position, the filling material being stored in the transfer container in the closed position of the seal, and, in the open position of the seal, the filling material being transferred from an opening of the transfer container to the filling device under the influence of gravity, and the seal being openable a) in accordance with the position of the transfer container relative to the filling device and/or b) in accordance with the speed of the transfer container.

3. The transfer element according to claim 1, wherein the filling material is accommodated in a transport volume of the transfer containers, the cross section of the transport volume expanding from the top towards bottom.

4. The transfer element according to claim 1, wherein in the area of the seal of the transfer container, the cross section of the transport volume matches the cross section at the inlet of the filling device of the tubular bag machine.

5. The transfer element according to claim 1, wherein the cross section of the transport volume of the transfer containers is adaptable.

6. The transfer element according to claim 1, wherein the filling device is realized in the manner of a forming tube, a film tube being guided on the outer surface of the forming tube.

7. The transfer element according to claim 1, wherein the dosing device comprises at least a weighing scale or at least a screw conveyor or at least a meter or at least a volume dosing element for measuring the filling material.

8. The transfer element according to claim 1, wherein the transfer control system controls the position of the transfer containers and/or the conveying speed of the transfer containers by means of a sensor technology.

9. The transfer element according to claim 1, wherein the transfer control system has a data interface by means of which the transfer control system can exchange data with a control system of the tubular bag machine.

10. The transfer element according to claim 1, wherein a discharge element, by means of which the filling material is discharged from the transport volume of the transfer container, is provided on the transfer containers and/or in the dispensing station.

11. The transfer element according to claim 10, wherein the discharge element is realized in the manner of a compressed-air nozzle, by means of which compressed air is blown on the filling material.

12. A method for operating a transfer element, which is provided for being arranged between a dosing device and the filling device of a tubular bag machine, the transfer element comprising at least one input station, at least one dispensing station and several transfer containers, and the prespecified filling quantity of a filling material being transferred from the dosing device to the transfer containers in the input station, and the transfer containers being transported to the dispensing station along a transfer line, and the filling material being transferred from the transfer containers to the filling device in the dispensing station, and the transfer containers being transported back to the input station along a return transfer line, wherein during the transport movement of the transfer containers in the dispensing station, the filling material is transferred at least partly to the filling device along the transfer line and/or along the return transfer line and wherein the transfer containers have a seal, which is adjustable between a closed position and an open position, the seal being opened before the transfer container comes to a complete stop in the dispensing station.

* * * * *